US010870294B2

(12) United States Patent
Yamada

(10) Patent No.: US 10,870,294 B2
(45) Date of Patent: Dec. 22, 2020

(54) PRINTING APPARATUS

(71) Applicant: SEIKO EPSON CORPORATION, Tokyo (JP)

(72) Inventor: Koji Yamada, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/549,221

(22) Filed: Aug. 23, 2019

(65) Prior Publication Data

US 2020/0070548 A1 Mar. 5, 2020

(30) Foreign Application Priority Data

Aug. 28, 2018 (JP) ..... 2018-159272

(51) Int. Cl.

| | |
|---|---|
| ***B41J 3/407*** | (2006.01) |
| ***B41J 13/00*** | (2006.01) |
| ***B41J 15/04*** | (2006.01) |
| ***B65H 23/038*** | (2006.01) |
| ***B41J 13/02*** | (2006.01) |
| ***B41J 13/10*** | (2006.01) |
| ***B41J 13/036*** | (2006.01) |
| ***B65H 18/10*** | (2006.01) |
| ***B41J 11/00*** | (2006.01) |

(52) U.S. Cl.

CPC ..... *B41J 13/0009* (2013.01); *B41J 3/4075* (2013.01); *B41J 11/0055* (2013.01); *B41J 13/025* (2013.01); *B41J 13/036* (2013.01); *B41J 13/103* (2013.01); *B41J 15/04* (2013.01); *B65H 18/103* (2013.01); *B65H 23/038* (2013.01); *B65H 2301/51122* (2013.01); *B65H 2701/194* (2013.01); *B65H 2801/12* (2013.01)

(58) Field of Classification Search

CPC ..... B41J 13/0009; B41J 15/04; B41J 13/025; B41J 13/103; B41J 13/036; B41J 3/4075; B41J 11/0055; B65H 23/038; B65H 18/103; B65H 2701/194; B65H 2301/51122; B65H 2801/12

See application file for complete search history.

(56) References Cited

U.S. PATENT DOCUMENTS 7,404,558 B2 * 7/2008 Kanome ..... B65H 5/062 271/258.01
2016/0200473 A1 * 7/2016 Nitta ..... B65C 9/1807 492/27

FOREIGN PATENT DOCUMENTS

JP 2016-124674 A 7/2016
JP 2016124674 A * 7/2016 ..... B65H 23/038

* cited by examiner

*Primary Examiner* — Yaovi M Ameh
(74) *Attorney, Agent, or Firm* — Workman Nydegger

(57) ABSTRACT

Provided is a printing apparatus including a printing head, transport rollers (sheet transport rollers) configured to sandwich and transport a medium (label sheet), a medium bending unit (bending member) configured to bend the label sheet to peel off a label from a backing sheet when the label sheet has a configuration in which the label is attached to the backing sheet, and a medium guide (sheet guide) configured to contact with one edge in a width direction of the label sheet to be bent by the bending member. The sheet transport rollers include a biasing mechanism configured to bias the label sheet in a direction intersecting a transport direction of the label sheet and also toward the sheet guide, during transport of the label sheet.

3 Claims, 4 Drawing Sheets

PRINTING APPARATUS

The present application is based on, and claims priority from JP Application Serial Number 2018-159272, filed Aug. 28, 2018, the disclosure of which is hereby incorporated by reference herein in its entirety.

BACKGROUND

1. Technical Field

The present disclosure relates to a printing apparatus for performing printing on labels of a roll sheet.

2. Related Art

Printing apparatuses for performing printing on a roll sheet wound to form a roll are known. Further, some roll sheets include a continuous band of backing sheet and a series of labels being attached to the backing sheet and spaced from each other. When printing is performed on the labels of such a roll sheet, the labels may need to be detached (peeled) from the backing sheet after the printing.

A printing apparatus disclosed in JP-A-2016-124674 includes a printing unit configured to perform printing on a label attached to a backing sheet, a bending member provided downstream from the printing unit on a feed path of the backing sheet and configured to bend the backing sheet, and a backing sheet conveying unit disposed downstream of the bending member on the feed path and configured to sandwich and convey the backing sheet. In addition, the printing apparatus further includes a backing sheet guide. The backing sheet guide includes a fixed guide and a movable guide, and the width of the backing sheet guide is changeable by moving the movable guide with respect to the fixed guide such that the backing sheet guide contacts with the lateral edges of the backing sheet.

In the printing apparatus disclosed in JP-A-2016-124674, due to the tolerance in the width dimension of the backing sheet, a gap including the tolerance is formed in the inner dimension of the backing sheet guide. Due to the gap being formed, the backing sheet may move leftward or rightward within the range of the gap. Therefore, the printing apparatus has a problem of slight position shift when the labels are ejected. In addition, the printing apparatus also has a problem of slight shift in the printing start position due to the leftward or rightward movement of the backing sheet.

SUMMARY

A printing apparatus according to the present application may include a printing head configured to perform printing on a medium, transport rollers configured to sandwich and transport the medium, a medium bending unit configured to bend the medium to peel off a label from a backing sheet when the medium has a configuration in which the label is attached to the backing sheet, and a medium guide configured to contact with one edge in a width direction of the medium to be bent by the medium bending unit. In the printing apparatus, the transport rollers may include a biasing mechanism configured to bias the medium in a direction intersecting a transport direction of the medium and also toward the medium guide, during the transport of the medium.

In the printing apparatus described above, the biasing mechanism may include a nip roller arranged in a direction intersecting the transport direction, and when a nip pressure in a first roller region by the nip roller is compared with a nip pressure in a second roller region by the nip roller, with the first roller region being a region that is located close to the medium guide and the second roller region being a region that is distanced farther from the medium guide than the first roller region, the nip pressure in a first roller region may be higher than the nip pressure in the second roller region.

In the printing apparatus described above, the biasing mechanism may include a plurality of nip rollers arranged in a direction intersecting the transport direction, and when a nip pressure by a first nip roller of the plurality of nip rollers is compared with a nip pressure by a second nip roller of the plurality of nip rollers, with the second nip roller being distanced farther from the medium guide than the first nip roller, the nip pressure by the first nip roller may be higher than the nip pressure by the second nip roller.

In the printing apparatus described above, the medium guide may be provided at the side of the one edge of the medium, and the other edge of the medium may be free without being constrained.

DESCRIPTION OF EXEMPLARY EMBODIMENTS

Figure 1:
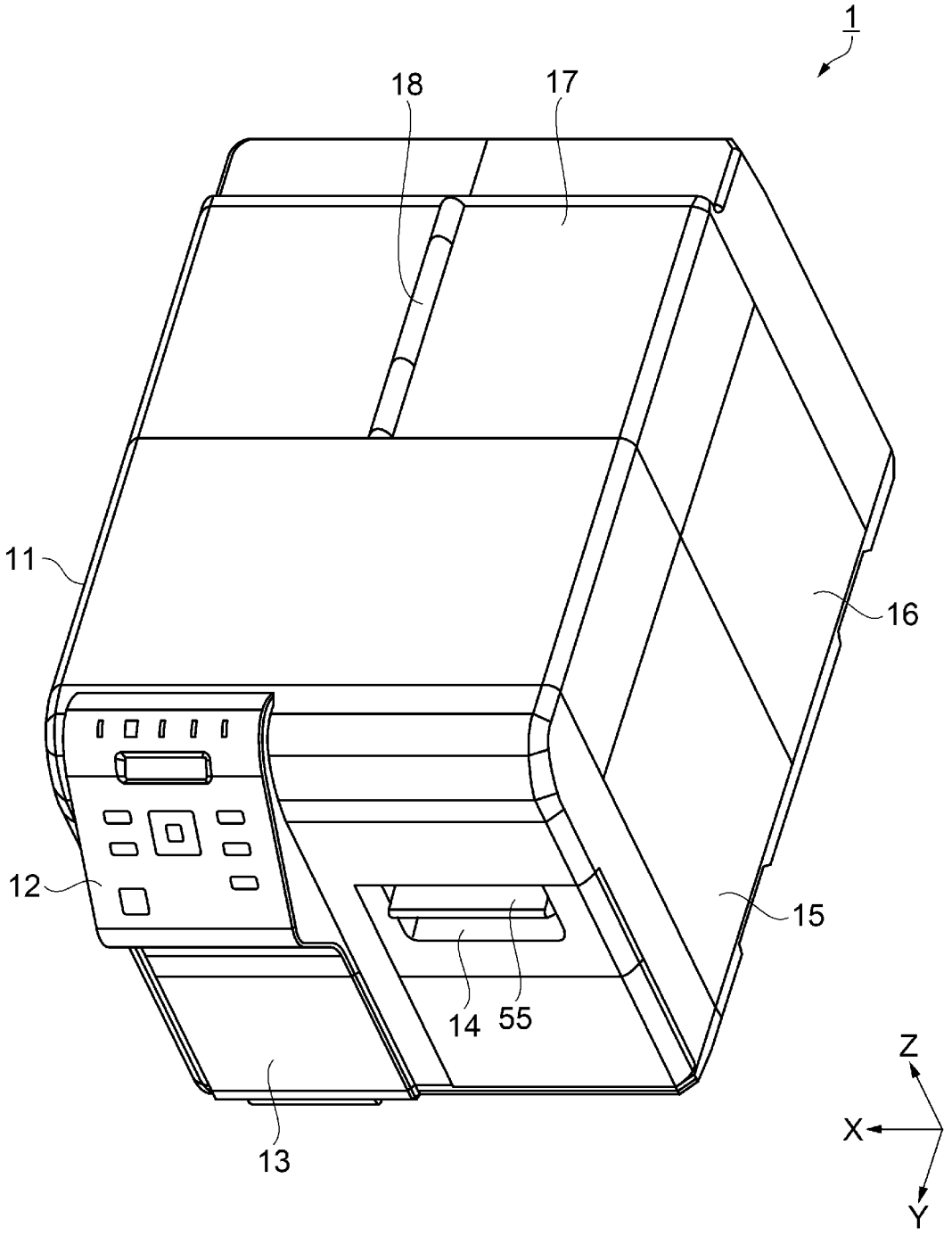
FIG. 1 is a perspective view illustrating an exterior of a printing apparatus according to an embodiment.

Embodiments of the present disclosure will be described below with reference to the accompanying drawings. Note that, each of members in the drawings below is illustrated to a scale different from an actual scale in order to make the members recognizable.

Figure 2:
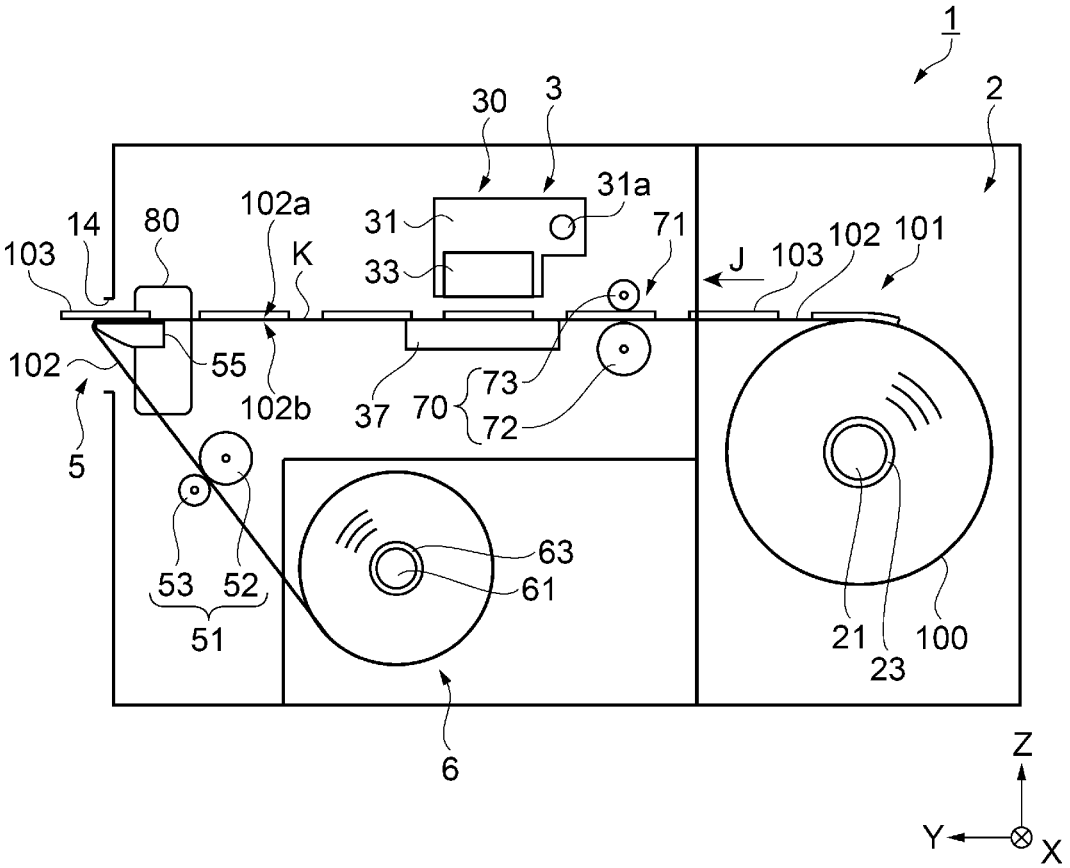
FIG. 2 is a cross-sectional view schematically illustrating a configuration of the printing apparatus according to the embodiment.

FIG. 1 is a perspective view illustrating an exterior of a printing apparatus 1 according to an embodiment. FIG. 2 is a cross-sectional view schematically illustrating a configuration of the printing apparatus 1 according to the embodiment. Note that the printing apparatus 1 according to the embodiment is a printing apparatus for creating a so-called label 103.

Note that an XYZ-coordinate system is used in each drawing. The X direction is along a main scanning axis of a printing head 33 (see FIG. 2), and is the width direction (also referred to as "width direction X" hereinafter) of the label 103 (see FIG. 2) to be printed. The Y direction is the depth direction (also referred to as "depth direction Y" hereinafter) of the printing apparatus 1 (see FIG. 1), and is the length direction of a label sheet 101 (see FIG. 2). The Z direction is the direction of gravity, the vertical direction, and the height direction of the printing apparatus 1 (also referred to as "height direction Z" hereinafter).

The forward direction with respect to the apparatus is defined as +Y direction, and the rearward direction with respect to the apparatus is defined as −Y direction. In addition, in the front view of the printing apparatus 1, the leftward direction with respect to the apparatus is defined as +X direction, and the rightward direction with respect to the apparatus is defined as −X direction. Furthermore, the upward direction with respect to the apparatus (including upper side, upper portion, top surface, and the like) is defined as +Z direction, and the downward direction with respect to the apparatus (including the lower side, lower portion, bottom surface, and the like) is defined as −Z direction.

Overview of Printing Apparatus 1

An overview of the printing apparatus 1 will be provided with reference to FIG. 1 and FIG. 2, and the matters described in this overview may be common to the embodiments described below.

The printing apparatus 1 according to the embodiment is configured to print, with ink jet printing, images and characters on the label 103 included in a roll sheet 100 based on print data transmitted from an information processing device, such as a personal computer and a mobile terminal.

As illustrated in FIG. 1, the printing apparatus 1 includes an apparatus case 11 having a substantially cubic shape. A display and operation panel 12 is provided on the front face of the apparatus case 11, and a display, an operation button, and the like are disposed on the display and operation panel 12. Furthermore, a draw-out-type ink cartridge replacement port 13 is provided on the front face of the apparatus case 11 and below the display and operation panel 12.

Further, a label ejection port 14 is provided on the front face of the apparatus case 11 and on the right side of the display and operation panel 12. As illustrated in FIG. 2, the label 103 printed by a printing unit 3 is ejected from the label ejection port 14. A backing sheet ejection port 15 and a roll sheet supplying port 16 are provided on the right side-face of the apparatus case 11. The apparatus case 11 includes an outer cover 17 configured to pivot around a hinge 18 provided substantially in the center of the top face of the apparatus.

Configuration and Operation of Printing Apparatus 1

Hereinafter, the configuration and operation of the printing apparatus 1 will be described with reference to FIG. 2.

As illustrated in FIG. 2, the roll sheet 100 is set in the printing apparatus 1. The roll sheet 100 is the label sheet 101 wound around a cylindrical core, for example, a paper tube 23, to form a roll. The label sheet 101 includes a backing sheet 102 and a plurality of labels 103.

The backing sheet 102 is a band-shaped continuous sheet. The plurality of labels 103 are attached to a front surface 102*a* of the backing sheet 102 so that the plurality of labels 103 are substantially evenly spaced from each other in the length direction of the backing sheet 102. Note that a surface opposite to the front surface 102*a* will be referred to as a back surface 102*b*. The label 103 is peelable from the backing sheet 102. A plurality of types of backing sheet 102 having different widths are provided. Note that the materials and the types of adhesive used for the backing sheet 102 and the label 103 are not particularly limited. Furthermore, in the embodiment, a printed article to be attached to an attachment target is referred to as a "label".

As illustrated in FIG. 2, a transport path K being a path on which the label sheet 101 is transported, is formed in the printing apparatus 1. The label sheet 101 fed from the roll sheet 100 is transported along the transport path K in the transport direction J.

The printing apparatus 1 includes a label sheet feeding unit 2, the printing unit 3, a peeling unit 5, and a backing sheet winding unit 6.

Hereinafter, the operation of the printing apparatus 1 will be briefly described.

In the label sheet feeding unit 2, the roll sheet 100 is set on a roll sheet mounting portion 21 so that the roll sheet 100 can be fed.

The printing unit 3 is configured to perform ink jet printing on each of the labels 103 based on image data received from a personal computer (not illustrated) or the like in communication with the printing unit 3.

The peeling unit 5 is configured to peel off, by a bending member 55, the printed label 103 from the backing sheet 102. The peeled label 103 is ejected from the label ejection port 14. Note that the ejected label 103 is held by the hand of a user and attached to the attachment target.

The backing sheet winding unit 6 is configured to wind, on a backing sheet mounting portion 61, the backing sheet 102 from which the labels 103 have been peeled off.

First Embodiment

Hereinafter, operations of the printing apparatus 1 according to First Embodiment will be described in detail.

As illustrated in FIG. 2, the label sheet feeding unit 2 includes the roll sheet mounting portion 21. By inserting the paper tube 23 of the roll sheet 100 into the roll sheet mounting portion 21, the roll sheet 100 is set rotatably with respect to the roll sheet mounting portion 21. As a result, the label sheet 101 rotates as the roll sheet mounting portion 21 is rotated, and thus the label sheet 101 is fed.

The printing unit 3 includes sheet transport rollers 70, a print unit 30, and a platen 37. The sheet transport rollers 70 are configured as transport rollers configured to sandwich and transport a medium (label sheet 101). The sheet transport rollers 70 are provided upstream from the printing head 33 in the transport direction J of the label sheet 101. The sheet transport rollers 70 are configured to sandwich and transport the label sheet 101 toward the platen 37. Note that the printing apparatus 1 according to the embodiment is a serial type printing apparatus, thus the transport speed of the label sheet 101 is not constant. The sheet transport rollers 70 are intermittently driven by a below-described first driving source to intermittently transport the label sheet 101 in the transport direction J.

The sheet transport rollers 70 include a sheet transport driving roller 72 and sheet transport driven rollers 73, which serve as a nip roller. The sheet transport driving roller 72 is rotationally driven by power transmitted from the first driving source (not illustrated) including a feed motor or the like. The sheet transport driven rollers 73 are in contact with the sheet transport driving roller 72 to be rotationally driven by the sheet transport driving roller 72. Note that the sheet transport driving roller 72 and the sheet transport driven rollers 73 are provided in a direction intersecting the transport direction J. The sheet transport driving roller 72 and the sheet transport driven rollers 73 function as a biasing mechanism 71 described below.

The platen 37 and the print unit 30 are provided downstream from the sheet transport rollers 70. A plurality of suction holes (not illustrated) are provided on a top surface of the platen 37, and each of the suction holes is in communication with a suction fan (not illustrated). As such, the label sheet 101 is transported while suctioned to the top surface of the platen 37 by the suction holes. Thus, it is possible to prevent the label sheet 101 from interfering with the nozzle face of the printing head 33.

The print unit 30 includes a carriage 31 and the printing head 33 mounted on the carriage 31. The carriage 31 is supported by a carriage shaft 31*a* extending along a main scanning axis (the width direction X in the embodiment) perpendicular to the transport direction J. The carriage 31 moves to and fro along the carriage shaft 31*a* along the main scanning axis to achieve scanning motion of the printing head 33.

The printing head 33 is a serial type ink jet head and includes nozzle rows for different colors (e.g., four colors including cyan, yellow, magenta, and black). The printing head 33 is supplied with ink from ink cartridges (not illustrated). The printing head 33 ejects the ink from the nozzle included in each of the nozzle rows, onto the label sheet 101 (label 103) on the platen 37 to print an image.

In the printing unit 3 having such a configuration, sub scanning, in which the sheet transport rollers 70 pull out the label sheet 101 from the roll sheet 100 set at the roll sheet mounting portion 21 of the label sheet feeding unit 2 and intermittently transport the label sheet 101 in the transport direction J, and main scanning, in which the printing head 33 moves to and fro in the width direction X while ejecting ink onto the label sheet 101 (label 103), are alternately repeated to print an image or characters on the label sheet 101 (label 103). In other words, the printing unit 3 is configured to perform printing operations including the main scanning and the sub scanning in order to print an image and characters on the label sheet 101 (label 103).

Note that the printed label sheet 101 is further conveyed toward the peeling unit 5.

The peeling unit 5 includes the bending member 55 and backing sheet transport rollers 51. The peeling unit 5 further includes a sheet guide 80 serving as a medium guide.

The backing sheet transport rollers 51 are provided downstream from the bending member 55 in the transport direction J of the label sheet 101. The backing sheet transport rollers 51 are configured to sandwich the backing sheet 102 and transport the backing sheet 102 toward the backing sheet winding unit 6.

The backing sheet transport rollers 51 include a backing sheet transport driving roller 52 configured to be rotationally driven by power transmitted from a second driving source (not illustrated) including a winding motor or the like, and a backing sheet transport driven roller 53 in contact with the backing sheet transport driving roller 52 to be rotationally driven by the backing sheet transport driving roller 52.

The bending member 55 serving as a medium bending unit is provided downstream from the printing unit 3 in the transport direction J. Here, the bending member 55 is formed of a plate-shaped member. The cross-sectional shape of the bending member 55 in the depth direction Y of the apparatus has a tip having a small radius (approximately 1 mm) on the apparatus front face of the cross-sectional shape, and the cross-sectional shape extends in the width direction X.

The bending member 55 is a member for bending the transport direction J (transport path K) of the label sheet 101 at an acute angle so that the back surface 102*b* of the backing sheet 102 faces the inside, in other words, so that the surface opposite to the surface to which the label 103 is attached faces the inside. Due to the difference in rigidity between the backing sheet 102 and the label 103, only the backing sheet 102 having rigidity lower than that of the label 103 is bent at the tip of the bending member 55. On the other hand, the label 103 having rigidity higher than that of the backing sheet 102 is peeled off from the backing sheet 102 at the tip of the bending member 55 and is conveyed forward.

In the peeling unit 5 having such a configuration, when the backing sheet transport rollers 51 are operated, the backing sheet 102 is bent at an acute angle by the bending member 55, and conveyed toward the backing sheet winding unit 6 while being under tension. As a result, the label 103 is peeled off from the backing sheet 102 at the position of the bending member 55.

The backing sheet winding unit 6 includes the backing sheet mounting portion 61. For example, the backing sheet mounting portion 61 is inserted into a cylindrical paper tube 63 so that the paper tube 63 is set so as to be rotated with the backing sheet mounting portion 61. As a result, the paper tube 63 rotates as the backing sheet mounting portion 61 is rotated. The backing sheet 102 from which the label 103 has been peeled off is wound to form a roll having, as a core, the paper tube 63 provided in the above-described manner.

In the embodiment, as illustrated in FIG. 2, the sheet guide 80 is provided. The sheet guide 80 functions as a medium guide configured to contact with one edge in the width direction of the label sheet 101 to be bent by the bending member 55. In the embodiment, the sheet guide 80 is provided, for example, on the +X side (on the left of the bending member 55 in the front view of the apparatus) in the width direction X of the bending member 55. Further, the sheet guide 80 is provided so as to be in contact with the +X side edge of the label sheet 101 that is transported from the printing unit 3 (the left edge of the label sheet 101 in the front view of the apparatus). Note that the sheet guide 80 is provided at the side of one edge of the label sheet 101 (the +X side edge, in the embodiment), and the other edge of the label sheet 101 (the −X side edge) is free without being constrained.

Figure 3:
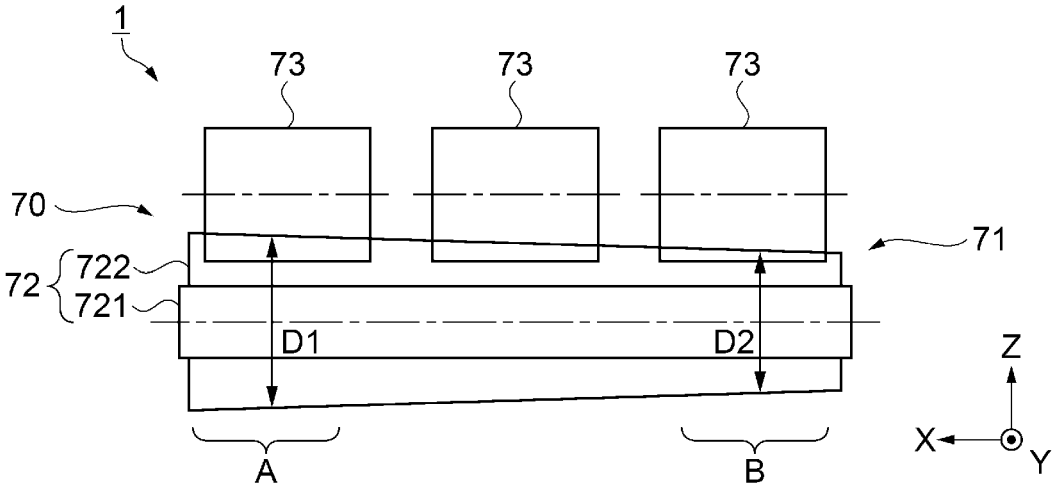
FIG. 3 is a schematic cross-sectional view illustrating sheet transport rollers according to First Embodiment.

FIG. 3 is a schematic cross-sectional view illustrating the sheet transport rollers 70 according to First Embodiment. Note that FIG. 3 is a schematic cross-sectional view of the sheet transport rollers 70 as viewed from the front of the apparatus. Further, the three sheet transport driven rollers 73 illustrated in FIG. 3 are simplified representations of a plurality of sheet transport driven rollers 73. The configuration and operation of the sheet transport rollers 70 in the embodiment will be described with reference to FIG. 3.

As described above, the sheet transport rollers 70 include the sheet transport driving roller 72 and the sheet transport driven rollers 73, which serve as nip rollers. As illustrated in FIG. 3, the sheet transport driving roller 72 includes a cylindrical metal roller core 721 extending in the width direction X (the direction intersecting the transport direction J) and having a constant diameter, and an elastic member 722 covering the outer surface of the roller core 721 and having a uniformly changing diameter. Note that equal hardness is found everywhere throughout the elastic member 722. Furthermore, a rubber or an elastomer material may be used for the elastic member 722.

As illustrated in FIG. 3, in the sheet transport driving roller 72, a region closer to the sheet guide 80 is defined as a first roller region A, and a region farther from the sheet guide 80 than the first roller region A is defined as a second roller region B. In other words, in the sheet transport driving roller 72, a region closer to the +X side edge (one edge) of the label sheet 101 is defined as the first roller region A, and a region farther from the +X side edge (the one edge) of the label sheet 101 is defined as the second roller region B. Here, the elastic member 722 is formed to satisfy D1>D2, where D1 represents the diameter of the elastic member 722 in the first roller region A and D2 represents the diameter of the elastic member 722 in the second roller region B.

Note that, in the embodiment, when a first roller region is the first roller region A, a second roller region being a region farther from the sheet guide 80 than the first roller region is the second roller region B.

The sheet transport driven rollers 73 include a plurality of cylindrical rollers having the similar hardness and the same diameter. The central axes of the sheet transport driven rollers 73 substantially coincide when viewed in the X direction while the sheet transport driving roller 72 is driven. In addition, the central axis of each of the sheet transport driven rollers 73 is provided so as to keep a predetermined distance from the central axis of the sheet transport driving roller 72, and the predetermined distance is a distance that allows the label sheet 101 to be sandwiched and transported.

When the sheet transport rollers 70 including the sheet transport driving roller 72 and the sheet transport driven rollers 73 are driven, the nip amount by the sheet transport rollers 70 is greater in the first roller region A than in the second roller region B. As a result, the nip pressure in the first roller region A is greater than that in the second roller region B. When the sheet transport rollers 70 are continuously driven in this situation, the label sheet 101 being transported in the transport direction J may gradually deflect (turn) to the side where a higher nip pressure is applied. When continuously transported in this situation, the label sheet 101 is transported in a direction intersecting with the transport direction J and toward the sheet guide 80.

Note that, in the embodiment, a mechanism for biasing, by the sheet transport rollers 70, the label sheet 101 in a direction intersecting the transport direction J of the label sheet 101 and toward the sheet guide 80 during transport of the label sheet 101 is referred to as the biasing mechanism 71. The biasing mechanism 71 includes the sheet transport rollers 70 (the sheet transport driving roller 72 and the sheet transport driven rollers 73).

When transportation is continued by the sheet transport rollers 70, the biasing mechanism 71 allows the label sheet 101 to be transported with the +X side edge in the width direction of the label sheet 101 being in contact with the sheet guide 80.

As described above, the printing apparatus 1 according to the embodiment can provide the following advantages.

In the printing apparatus 1 according to the embodiment, the sheet transport rollers 70 includes the biasing mechanism 71. The biasing mechanism 71 (sheet transport rollers 70) includes the sheet transport driving roller 72 and the sheet transport driven rollers 73, which are oriented in a direction intersecting the transport direction J and serve as nip rollers. Note that, in the sheet transport driving roller 72, the diameter D1 of the first roller region A which is a region closer to the sheet guide 80 is larger than the diameter D2 of the second roller region B which is a region farther from the sheet guide 80 than the first roller region A. As a result, the nip pressure in the first roller region A is greater than that in the second roller region B. Thus, when the sheet transport rollers 70 are continuously driven, the label sheet 101 can be transported in a direction intersecting the transport direction J and toward the sheet guide 80. As a result, it is possible to transport the label sheet 101 with one edge of the label sheet 101 (in the embodiment, the +X side edge in the width direction) being in contact with the sheet guide 80. Thus, a position shift of the label sheet 101 in the left or right direction can be suppressed, and thus an ejection position shift of the label 103 and a printing start position shift upon performing printing on the label 103 can be prevented.

In the printing apparatus 1 according to the embodiment, the sheet guide 80 is provided at the side of one edge of the label sheet 101 (the +X side edge, in the embodiment), and the other edge of the label sheet 101 (the −X side edge) is free without being constrained. Therefore, it is possible to eliminate the necessity to provide a variable sheet width guide, which is used in known printers for accommodating various label sheets 101 having different sheet widths.

Second Embodiment

Figure 4:
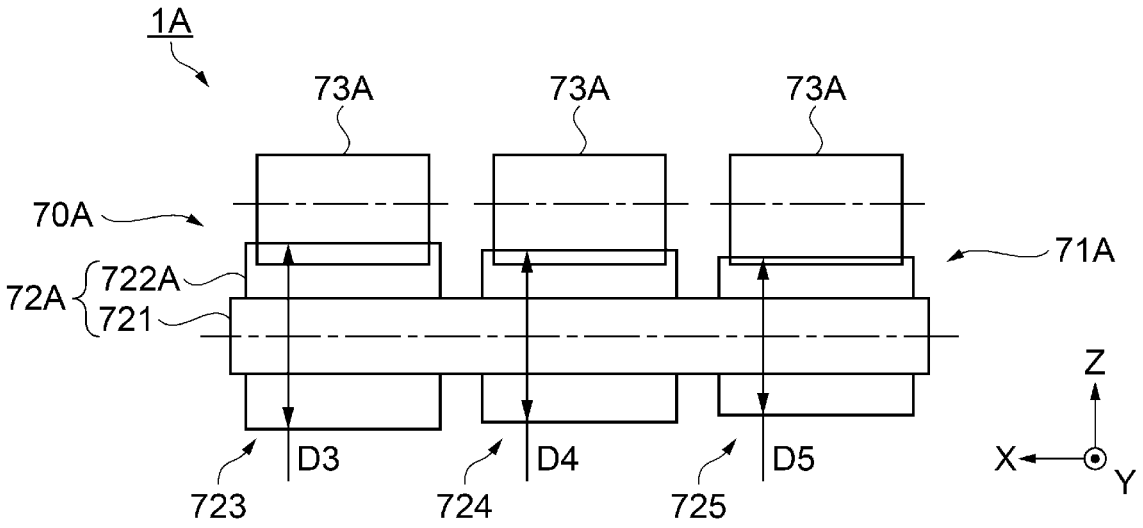
FIG. 4 is a schematic cross-sectional view illustrating sheet transport rollers according to Second Embodiment.

FIG. 4 is a schematic cross-sectional view illustrating sheet transport rollers 70A according to Second Embodiment. Note that FIG. 4 is a schematic cross-sectional view of the sheet transport rollers 70A as viewed from the front of the apparatus. Further, three sheet transport driving rollers 72A and three sheet transport driven rollers 73A illustrated in FIG. 4 are simplified representations of a plurality of sheet transport driving rollers 72A and a plurality of sheet transport driven rollers 73A. The configuration and operation of the sheet transport rollers 70A in the embodiment will be described with reference to FIG. 4.

Note that a printing apparatus 1A according to the embodiment has the same configuration as First Embodiment, except that the sheet transport rollers 70A included in a biasing mechanism 71A have a configuration different from that of the sheet transport rollers 70 included in the biasing mechanism 71 of the printing apparatus 1 according to First Embodiment. Like reference numerals refer to like components.

The sheet transport rollers 70A in the embodiment include the sheet transport driving rollers 72A and the sheet transport driven rollers 73A, which serve as nip rollers. As illustrated in FIG. 4, the sheet transport driving rollers 72A include a cylindrical metal roller core 721 extending in the width direction X (the direction intersecting the transport direction J) and having a constant diameter, and a plurality of elastic members 722A covering the outer surface of the roller core 721 and having different diameters. Note that the plurality of elastic members 722A are formed to have the same hardness.

As illustrated in FIG. 4, regarding the sheet transport driving rollers 72A, a sheet transport driving roller 72A closest to the sheet guide 80 is defined as a first sheet transport driving roller 723, and sheet transport driving rollers 72A farther from the sheet guide 80 than the first sheet transport driving roller 723 are defined as a second sheet transport driving roller 724 and a third sheet transport driving roller 725, respectively, where a higher ordinal number means the roller being farther from the guide member 80. In other words, regarding the sheet transport driving rollers 72A, the sheet transport driving roller 72A closest to the +X side edge (one edge) of the label sheet 101 is referred to as the first sheet transport driving roller 723, and the sheet transport driving rollers 72A farther from the +X side edge (the one edge) of the label sheet 101 than the first sheet transport driving roller 723, are defined as the second sheet transport driving roller 724 and the third sheet transport driving roller 725, respectively, where a higher ordinal number means the roller being farther from the +X side edge.

Note that, in the embodiment, when a first nip roller is the first sheet transport driving roller 723, a second nip roller, which is a nip roller farther from the sheet guide 80 than the first nip roller, is the second sheet transport driving roller 724 or the third sheet transport driving roller 725.

Note that the first sheet transport driving roller 723 includes the shared roller core 721 and the elastic member 722A having a different diameter as described below. Each of the second and third sheet transport driving rollers 724 and 725 also has a similar configuration.

Here, the elastic members 722A are formed to satisfy D3>D4>D5, where D3 represents the diameter of the elastic member 722A in the first sheet transport driving roller 723, D4 represents the diameter of the elastic member 722A in the second sheet transport driving roller 724, and D5 represents the diameter of the elastic member 722A in the third sheet transport driving roller 725.

The sheet transport driven rollers 73A include a plurality of cylindrical rollers having the same diameter and the similar hardness. The central axes of the sheet transport driven rollers 73A substantially coincide when viewed in the X direction while the sheet transport driving rollers 72A are driven. In addition, the central axis of each of the sheet transport driven rollers 73A is provided so as to keep a predetermined distance from the central axis of the sheet transport driving roller 72A, and the predetermined distance is a distance that allows the label sheet 101 to be sandwiched and transported.

When the sheet transport rollers 70A including the sheet transport driving rollers 72A and the sheet transport driven rollers 73A are driven, in the sheet transport rollers 70A, the nip amount in the first sheet transport driving roller 723 is greater than the nip amount in the second sheet transport driving roller 724. Furthermore, the nip amount in the second sheet transport driving roller 724 is greater than that in the third sheet transport driving roller 725. As a result, the nip pressure in the first sheet transport driving roller 723 is greater than that in the second sheet transport driving roller 724. Furthermore, the nip pressure in the second sheet transport driving roller 724 is greater than that in the third sheet transport driving roller 725.

When the sheet transport rollers 70A are continuously driven in this situation, the label sheet 101 being transported in the transport direction J may gradually deflect (turn) to the side where a higher nip pressure is applied. When continuously transported in this situation, the label sheet 101 is transported in a direction intersecting with the transport direction J and toward the sheet guide 80.

Note that, in the embodiment, a mechanism for biasing, by the sheet transport rollers 70A, the label sheet 101 in a direction intersecting the transport direction J of the label sheet 101 and toward the sheet guide 80 during transport of the label sheet 101 is referred to as the biasing mechanism 71A. The biasing mechanism 71A includes the sheet transport rollers 70A (the sheet transport driving rollers 72A and the sheet transport driven rollers 73A).

When transportation is continued by the sheet transport roller 70A, the biasing mechanism 71A allows the label sheet 101 to be transported with the +X side edge in the width direction of the label sheet 101 being in contact with the sheet guide 80.

As described above, the printing apparatus 1A according to the embodiment can provide the following advantages.

In the printing apparatus 1A according to the embodiment, the sheet transport rollers 70A includes the biasing mechanism 71A. The biasing mechanism 71A (sheet transport rollers 70A) includes the sheet transport driving roller 72A and the sheet transport driven rollers 73A, which are oriented in a direction intersecting the transport direction J and serve as nip rollers. Note that, in the sheet transport driving rollers 72A, the diameter D3 of the first sheet transport driving roller 723 which is a roller closest to the sheet guide 80 is larger than the diameter D4 of the second sheet transport driving roller 724 which is a roller farther from the sheet guide 80 than the first sheet transport driving roller 723. Further, the diameter D4 of the second sheet transport driving roller 724 is larger than the diameter D5 of the third sheet transport driving roller 725 which is a roller farther from the sheet guide 80 than the second sheet transport driving roller 724. As a result, the nip pressure in the first sheet transport driving roller 723 is greater than that in the second sheet transport driving roller 724. Additionally, the nip pressure in the second sheet transport driving roller 724 is greater than that in the third sheet transport driving roller 725. Thus, when the sheet transport rollers 70A are continuously driven, the label sheet 101 can be transported in a direction intersecting the transport direction J and toward the sheet guide 80. As a result, it is possible to transport the label sheet 101 with one edge of the label sheet 101 (in the embodiment, the +X side edge in the width direction) being in contact with the sheet guide 80. Therefore, as in First Embodiment, a position shift of the label sheet 101 in the left or right direction can be suppressed, and thus an ejection position shift of the label 103 and a printing start position shift upon performing printing on the label 103 can be prevented.

In the printing apparatus 1A according to the embodiment, the sheet guide 80 is provided at the side of one edge of the label sheet 101 (the +X side edge, in the embodiment), and the other edge of the label sheet 101 (the −X side edge) is free without being constrained. Therefore, as in First Embodiment, it is possible to eliminate the necessity to provide a variable sheet width guide, which is used in known printers for accommodating various label sheets 101 having different sheet widths.

Third Embodiment

Figure 5:
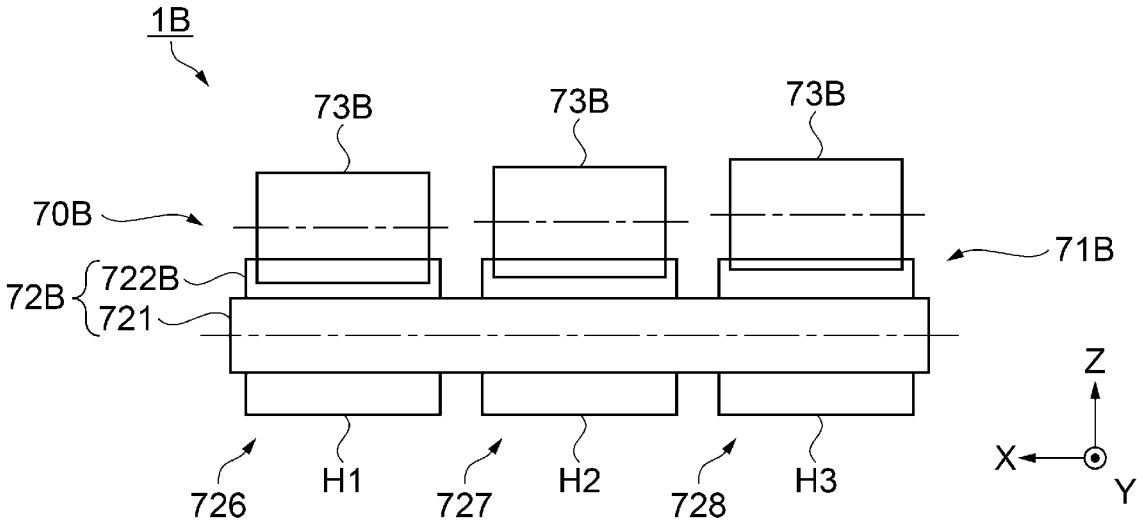
FIG. 5 is a schematic cross-sectional view illustrating sheet transport rollers according to Third Embodiment.

FIG. 5 is a schematic cross-sectional view illustrating sheet transport rollers 70B according to Third Embodiment. Note that FIG. 5 is a schematic cross-sectional view illustrating the sheet transport rollers 70B as viewed from the front of the apparatus. Further, three sheet transport driving rollers 72B and three sheet transport driven rollers 73B illustrated in FIG. 5 are simplified representations of a plurality of sheet transport driving rollers 72B and a plurality of sheet transport driven rollers 73B. The configuration and operation of the sheet transport rollers 70B in the embodiment will be described with reference to FIG. 5.

Note that a printing apparatus 1B according to the embodiment has the same configuration as Second Embodiment, except that the sheet transport rollers 70B included in a biasing mechanism 71B have a configuration different from that of the sheet transport rollers 70A included in the biasing mechanism 71A of the printing apparatus 1A according to Second Embodiment. Like reference numerals refer to like components.

The sheet transport rollers 70B in the embodiment include the sheet transport driving rollers 72B and the sheet transport driven rollers 73B, which serve as nip rollers. As illustrated in FIG. 5, the sheet transport driving rollers 72B include a cylindrical metal roller core 721 extending in the width direction X (the direction intersecting the transport direction J) and having a constant diameter, and a plurality of elastic members 722B covering the outer surface of the roller core 721 and having the same diameter and different hardness.

As illustrated in FIG. 5, regarding the sheet transport driving rollers 72B, a sheet transport driving roller 72B closest to the sheet guide 80 is defined as a first sheet transport driving roller 726, and sheet transport driving rollers 72B farther from the sheet guide 80 than the first sheet transport driving roller 726 are defined as a second sheet transport driving roller 727 and a third sheet transport driving roller 728, respectively, where a higher ordinal number means the roller being farther from the guide member 80. In other words, regarding the sheet transport driving rollers 72B, the sheet transport driving roller 72B closest to the +X side edge (one edge) of the label sheet 101 is defined as the first sheet transport driving roller 726, and the sheet transport driving rollers 72B farther from the +X side edge (the one edge) of the label sheet 101 than the first sheet transport driving roller 726, are defined as the second sheet transport driving roller 727 and the third sheet transport driving roller 728, respectively, where a higher ordinal number means the roller being farther from the +X side edge.

Note that, in the embodiment, when a first nip roller is the first sheet transport driving roller 726, a second nip roller, which is a nip roller farther from the sheet guide 80 than the first nip roller, is the second sheet transport driving roller 727 or the third sheet transport driving roller 728.

Note that the first sheet transport driving roller 726 includes the shared roller core 721 and the elastic member 722B having different hardness as described below. Each of the second and third sheet transport driving rollers 727 and 728 also has a similar configuration.

Here, elastic members 722B are formed to satisfy H1<H2<H3, where H1 represents the hardness of the elastic member 722B in the first sheet transport driving roller 726, H2 represents the hardness of the elastic member 722B in the second sheet transport driving roller 727, and H3 represents the hardness of the elastic member 722B in the third sheet transport driving roller 728.

The sheet transport driven rollers 73B include a plurality of cylindrical rollers having the same diameter and the similar hardness. Each of the sheet transport driven rollers 73B is set to apply the same pressing force to the corresponding sheet transport driving roller 72B. Thus, the central axes of the sheet transport driven rollers 73B, when viewed in the X direction while the sheet transport driving rollers 72B are driven, do not coincide with each other due to differences in hardness among the sheet transport driving rollers 72B to be pressed.

When the sheet transport rollers 70B including the sheet transport driving rollers 72B and the sheet transport driven rollers 73B are driven, in the sheet transport rollers 70B, the nip amount in the first sheet transport driving roller 726 is greater than the nip amount in the second sheet transport driving roller 727. Furthermore, the nip amount in the second sheet transport driving roller 727 is greater than that in the third sheet transport driving roller 728. As a result, the nip pressure in the first sheet transport driving roller 726 is greater than that in the second sheet transport driving roller 727. Furthermore, the nip pressure in the second sheet transport driving roller 727 is greater than that in the third sheet transport driving roller 728.

When the sheet transport rollers 70B are continuously driven in this situation, the label sheet 101 being transported in the transport direction J may gradually deflect (turn) to the side where a higher nip pressure is applied. When continuously transported in this situation, the label sheet 101 is transported in a direction intersecting with the transport direction J and toward the sheet guide 80.

Note that, in the embodiment, a mechanism for biasing, with the sheet transport rollers 70B, the label sheet 101 in a direction intersecting the transport direction J of the label sheet 101 and toward the sheet guide 80, during transport of the label sheet 101 is referred to as the biasing mechanism 71B. The biasing mechanism 71B includes the sheet transport rollers 70B (the sheet transport driving rollers 72B and the sheet transport driven rollers 73B).

When transportation is continued by the sheet transport rollers 70B, the biasing mechanism 71B allows the label sheet 101 to be transported with the +X side edge in the width direction of the label sheet 101 being in contact with the sheet guide 80.

As described above, the printing apparatus 1B according to the embodiment can provide the following advantages.

In the printing apparatus 1B according to the embodiment, the sheet transport rollers 70B includes the biasing mechanism 71B. The biasing mechanism 71B (sheet transport rollers 70B) includes the sheet transport driving rollers 72B and the sheet transport driven rollers 73B, which are oriented in a direction intersecting the transport direction J and serve as nip rollers. Note that, in the sheet transport driving rollers 72B, the hardness H1 of the first sheet transport driving roller 726 which is a roller closest to the sheet guide 80 is lower than the hardness H2 of the second sheet transport driving roller 727 which is a roller farther from the sheet guide 80 than the first sheet transport driving roller 726. Further, the hardness H2 of the second sheet transport driving roller 727 is lower than the hardness H3 of the third sheet transport driving roller 728 which is a roller farther from the sheet guide 80 than the second sheet transport driving roller 727. As a result, the nip pressure in the first sheet transport driving roller 726 is greater than that in the second sheet transport driving roller 727. Additionally, the nip pressure in the second sheet transport driving roller 727 is greater than that in the third sheet transport driving roller 728. Thus, when the sheet transport rollers 70B are continuously driven, the label sheet 101 can be transported in a direction intersecting the transport direction J and toward the sheet guide 80. As a result, it is possible to transport the label sheet 101 with one edge of the label sheet 101 (in the embodiment, the +X side edge in the width direction) being in contact with the sheet guide 80. Therefore, as in Second Embodiment, a position shift of the label sheet 101 in the left or right direction can be suppressed, and thus an ejection position shift of the label 103 and a printing start position shift upon performing printing on the label 103 can be prevented.

In the printing apparatus 1B according to the embodiment, the sheet guide 80 is provided at the side of one edge of the label sheet 101 (the +X side edge, in the embodiment), and the other edge of the label sheet 101 (the −X side edge) is free without being constrained. Therefore, as in Second Embodiment, it is possible to eliminate the necessity to provide a variable sheet width guide, which is used in known printers for accommodating various label sheets 101 having different sheet widths.

Fourth Embodiment

Figure 6:
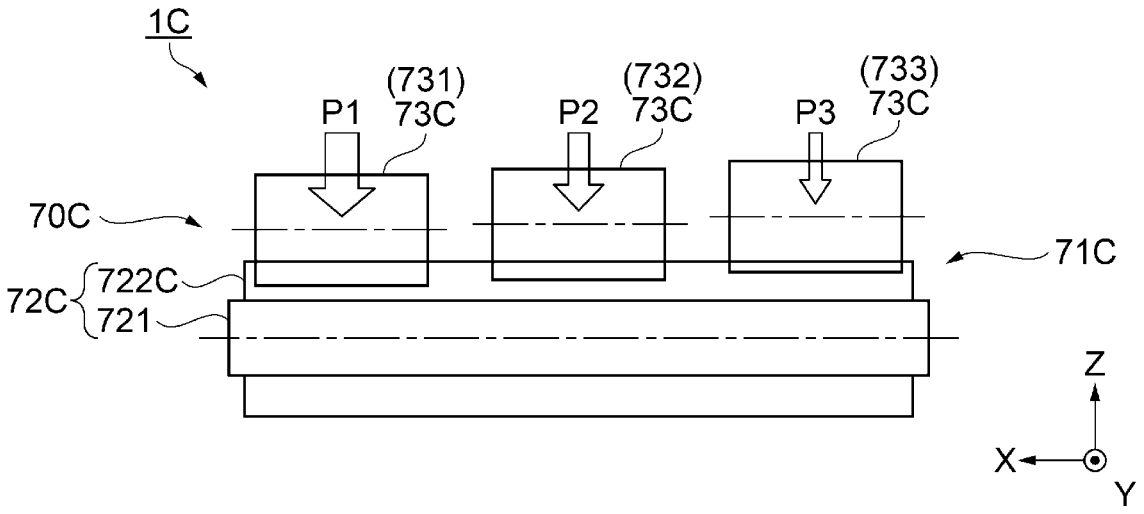
FIG. 6 is a schematic cross-sectional view illustrating sheet transport rollers according to Fourth Embodiment.

FIG. 6 is a schematic cross-sectional view illustrating sheet transport rollers 70C according to Fourth Embodiment. Note that FIG. 6 is a schematic cross-sectional view of the sheet transport rollers 70C as viewed from the front of the apparatus. Further, three sheet transport driven rollers 73C illustrated in FIG. 6 are simplified representations of a plurality of sheet transport driven rollers 73C. The configuration and operation of the sheet transport rollers 70C in the embodiment will be described with reference to FIG. 6.

Note that a printing apparatus 1C according to the embodiment has the same configuration as First Embodiment, except that the sheet transport rollers 70C included in a biasing mechanism 71C have a configuration different from that of the sheet transport rollers 70 included in the biasing mechanism 71 of the printing apparatus 1 according to First Embodiment. Like reference numerals refer to like components.

The sheet transport rollers 70C in the embodiment include sheet transport driving roller 72C and sheet transport driven rollers 73C, which serve as nip rollers. As illustrated in FIG. 6, the sheet transport driving roller 72C includes a cylindrical metal roller core 721 extending in the width direction X (the direction intersecting the transport direction J) and having a constant diameter, and an elastic member 722C covering the outer surface of the roller core 721 and having a constant diameter and a uniform hardness.

The sheet transport driven rollers 73C include a plurality of cylindrical rollers having the same diameter and the same hardness.

As illustrated in FIG. 6, regarding the sheet transport driven rollers 73C, a sheet transport driven roller 73C closest to the sheet guide 80 is defined as a first sheet transport driven roller 731, and sheet transport driven rollers 73C farther from the sheet guide 80 than the first sheet transport driven roller 731 are defined as a second sheet transport driven roller 732 and a third sheet transport driven roller 733, respectively, where a higher ordinal number means the roller being farther from the guide member 80. In other words, regarding the sheet transport driven rollers 73C, the sheet transport driven roller 73C closest to the +X side edge (one edge) of the label sheet 101 is defined as the first sheet transport driven roller 731, and the sheet transport driven rollers 73C farther from the +X side edge (the one edge) of the label sheet 101 than the first sheet transport driven roller 731, are defined as the second sheet transport driven roller 732 and the third sheet transport driven roller 733, respectively, where a higher ordinal number means the roller being farther from the +X side edge.

Note that, in the embodiment, when a first nip roller is the first sheet transport driven roller 731, a second nip roller, which is a nip roller farther from the sheet guide 80 than the first nip roller, is the second sheet transport driven roller 732 or the third sheet transport driven roller 733.

In the embodiment, each of the first sheet transport driven roller 731, the second sheet transport driven roller 732, and the third sheet transport driven roller 733 is set to apply different pressing force to the sheet transport driving roller 72C. Specifically, the pressing forces applied by springs (not illustrated) for pressing the respective sheet transport driven rollers 73C to the sheet transport driving roller 72C are different from each other.

The sheet transport driven rollers 73C are formed to satisfy P1>P2>P3, where P1 represents the pressing force applied to the sheet transport driving roller 72C by the first sheet transport driven roller 731, P2 represents the pressing force applied to the sheet transport driving roller 72C by the second sheet transport driven roller 732, and P3 represents the pressing force applied to the sheet transport driving roller 72C by the third sheet transport driven roller 733.

The sheet transport driven rollers 73C include a plurality of cylindrical rollers having the same diameter and the similar hardness. Each of the sheet transport driven rollers 73C is set to apply different pressing force to the corresponding part of the sheet transport driving roller 72C. Thus, the central axes of the sheet transport driven rollers 73C, when viewed in the X direction while the sheet transport driving roller 72C is driven, do not coincide with each other.

When the sheet transport rollers 70C including the sheet transport driving roller 72C and the sheet transport driven rollers 73C are driven, in the sheet transport rollers 70C, the nip amount in the first sheet transport driven roller 731 is greater than the nip amount in the second sheet transport driven roller 732. Furthermore, the nip amount in the second sheet transport driven roller 732 is greater than that in the third sheet transport driven roller 733. As a result, the nip pressure in the first sheet transport driven roller 731 is greater than that in the second sheet transport driven roller 732. Furthermore, the nip pressure in the second sheet transport driven roller 732 is greater than that in the third sheet transport driven roller 733.

When the sheet transport rollers 70C are continuously driven in this situation, the label sheet 101 being transported in the transport direction J may gradually deflect (turn) to the side where a higher nip pressure is applied. When continuously transported in this situation, the label sheet 101 is transported in a direction intersecting with the transport direction J and toward the sheet guide 80.

Note that, in the embodiment, a mechanism for biasing, by the sheet transport rollers 70C, the label sheet 101 in a direction intersecting the transport direction J of the label sheet 101 and toward the sheet guide 80, during transport of the label sheet 101 is referred to as the biasing mechanism 71C. The biasing mechanism 71C includes the sheet transport rollers 70C (the sheet transport driving roller 72C and the sheet transport driven rollers 73C).

When transportation is continued by the sheet transport roller 70C, the biasing mechanism 71C allows the label sheet 101 to be transported with the +X side edge in the width direction of the label sheet 101 being in contact with the sheet guide 80.

As described above, the printing apparatus 1C according to the embodiment can provide the following advantages.

In the printing apparatus 1C according to the embodiment, the sheet transport rollers 70C includes the biasing mechanism 71C. The biasing mechanism 71C (sheet transport rollers 70C) includes the sheet transport driving roller 72C and the sheet transport driven rollers 73C, which are oriented in a direction intersecting the transport direction J and serve as nip rollers. Note that, in the sheet transport driven rollers 73C, the pressing force P1 by the first sheet transport driven roller 731 which is a roller closest to the sheet guide 80 is greater than the pressing force P2 by the second sheet transport driven roller 732 which is a roller farther from the sheet guide 80 than the first sheet transport driven roller 731. Further, the pressing force P2 by the second sheet transport driven roller 732 is greater than the pressing force P3 by the third sheet transport driven roller 733 which is a roller farther from the sheet guide 80 than the second sheet transport driven roller 732. As a result, the nip pressure in the first sheet transport driven roller 731 is greater than that in the second sheet transport driven roller 732. Additionally, the nip pressure in the second sheet transport driven roller 732 is greater than that in the third sheet transport driven roller 733. Thus, when the sheet transport rollers 70C are continuously driven, the label sheet 101 can be transported in a direction intersecting the transport direction J and toward the sheet guide 80. As a result, it is possible to transport the label sheet 101 with one edge of the label sheet 101 (in the embodiment, the +X side edge in the width direction) being in contact with the sheet guide 80. Therefore, as in First Embodiment, a position shift of the label sheet 101 in the left or right direction can be suppressed, and thus an ejection position shift of the label 103 and a printing start position shift upon performing printing on the label 103 can be prevented.

In the printing apparatus 1C according to the embodiment, the sheet guide 80 is provided at the side of one edge of the label sheet 101 (the +X side edge, in the embodiment), and the other edge of the label sheet 101 (the −X side edge) is free without being constrained. Therefore, as in the first embodiment, it is possible to eliminate the necessity to provide a variable sheet width guide, which is used in known printers for accommodating various label sheets 101 having different sheet widths.

Note that, the present disclosure is not limited to the embodiments described above, and various modifications and improvements can be made to the above-described embodiments. Such modified examples are described below.

Modified Example 1

Although the sheet guide 80 in the embodiment is provided at the +X side of the bending member 55 so as to be contact with the +X side edge of the label sheet 101, the sheet guide 80 may be provided at the −X side of the bending member 55 so as to be in contact with the −X side edge of the label sheet 101. In this case, a biasing mechanism included in the transport rollers may have a configuration inverted with respect to the transport direction J (mirror-inverted with respect to the YZ plane).

Modified Example 2

In the embodiment, the sheet guide 80 is provided in the vicinity of the bending member 55. However, the sheet guide 80 is not limited thereto, and the sheet guide 80 may be provided downstream from the biasing mechanism in the transport direction J. Furthermore, the sheet guide 80 may be provided in a region downstream in the transport direction J from the biasing mechanism and not beyond the position of the bending member 55.

Modified Example 3

The sheet transport driving roller 72 in the first embodiment includes the metal roller core 721 and the elastic member 722. However, the present disclosure is not limited to this configuration, and the roller core 721 and the elastic member 722 having a region-dependent varying diameter may be integrally formed from a metal member. Note that the sheet transport driven rollers 73 may be configured in the same manner as First Embodiment. This configuration also can provide similar advantages.

Modified Example 4

The sheet transport driving roller 72A in the second embodiment includes the metal roller core 721 and the elastic members 722A. However, the present disclosure is not limited to this configuration, and the roller core 721 and the elastic members 722A having different diameters may be integrally formed from a metal member. Note that the sheet transport driven rollers 73A may be configured in the same manner as Second Embodiment. This configuration also can provide similar advantages.

Modified Example 5

The sheet transport driving rollers 72B in the third embodiment include the metal roller core 721 and the elastic members 722B. However, the present disclosure is not limited to this configuration, and the roller core 721 and the elastic members 722B having the same diameter may be integrally formed from a metal member. Note that, in this case, the elastic members included in the sheet transport driven rollers 73B may have the same diameter and different hardness. This configuration also can provide similar advantages.

Modified Example 6

The sheet transport driving roller 72C in the fourth embodiment includes the metal roller core 721 and the elastic member 722C. However, the present disclosure is not limited to this configuration, and the roller core 721 and the elastic member 722C having the same diameter may be integrally formed from a metal member. Note that the sheet transport driven rollers 73C may be configured in the same manner as the fourth embodiment. This configuration also can provide similar advantages.

Modified Example 7

In the sheet transport driving roller 72C in the fourth embodiment, the elastic member 722C having the constant diameter and uniform hardness may be divided into a plurality.

Contents derived from the above-described embodiments will be described below.

A printing apparatus may include a printing head configured to perform printing on a medium, transport rollers configured to sandwich and transport the medium, a medium bending unit configured to, when the medium has a configuration in which a label is attached to a backing sheet, bend the medium to peel off the label from the backing sheet, and a medium guide configured to contact with one edge in a width direction of the medium to be bent by the medium bending unit. In the printing apparatus, the transport rollers may include a biasing mechanism configured to bias, during transport of the medium, the medium in a direction intersecting a transport direction of the medium and toward the medium guide.

In this configuration, the transport rollers are configured to bias the medium in a direction intersecting a transport direction of the medium and toward the medium guide by the biasing mechanism during transport of the medium. Thus, the medium being transported may gradually deflect (turn) toward the medium guide. As a result, the medium may be transported with one edge of the medium in the width direction being in contact with the medium guide. Therefore, a position shift of the medium in the left or right direction can be suppressed, and thus an ejection position shift of the label and a printing start position shift upon performing printing on the label can be prevented.

In the printing apparatus described above, the biasing mechanism may include a nip roller arranged in a direction intersecting the transport direction, and a nip pressure in a first roller region of the nip roller, the first roller region being a region closer to the medium guide, may be higher than a nip pressure in a second roller region of the nip roller, the second roller region being a region farther from the medium guide than the first roller region.

According to this configuration, in the nip roller included in the biasing mechanism, the nip pressure in the first roller region, the first roller region being a region closer to the medium guide, may be higher than the nip pressure in the second roller region, the second roller region being a region farther from the medium guide than the first roller region. Thus, when the nip roller is continuously driven, the medium can be transported in a direction intersecting the transport direction and toward the medium guide. As a result, it is possible to transport the medium with one edge of the medium being in contact with the medium guide. Therefore, a position shift of the medium in the left or right direction can be suppressed, and thus an ejection position shift of the label and a printing start position shift upon performing printing on the label can be prevented.

In the printing apparatus described above, the biasing mechanism may include a plurality of nip rollers arranged in a direction intersecting the transport direction, and a nip pressure in a first nip roller included in the plurality of nip rollers may be higher than a nip pressure in a second nip roller included in the plurality of nip rollers, the second nip roller being located farther from the medium guide than the first nip roller.

According to this configuration, in the plurality of nip rollers included in the biasing mechanism, the nip pressure in the first nip roller may be higher than the nip pressure in the second nip roller, that is a roller farther from the medium guide than the first nip roller. Thus, when the nip rollers are continuously driven, the medium can be transported in a direction intersecting the transport direction and toward the medium guide. As a result, it is possible to transport the medium with one edge of the medium being in contact with the medium guide. Therefore, a position shift of the medium in the left or right direction can be suppressed, and thus an ejection position shift of the label and a printing start position shift upon performing printing on the label can be prevented.

In the printing apparatus described above, the medium guide may be provided at the side of one edge of the medium, and the other edge of the medium may be free without being constrained.

In this configuration, the medium guide may be provided at the side of the one edge of the medium, and the other edge of the medium may be free without being constrained. Thus, it is possible to eliminate the necessity to provide a variable sheet width guide, which is used in known printers for accommodating various media having different sheet widths.

What is claimed is:

1. A printing apparatus comprising:

a printing head configured to perform printing on a medium;

transport rollers configured to sandwich and transport the medium;

a medium bending unit configured to bend the medium to peel off a label from a backing sheet when the medium has a configuration in which the label is attached to the backing sheet; and a medium guide configured to contact with one edge in a width direction of the medium to be bent by the medium bending unit, wherein the transport rollers include a biasing mechanism configured to bias the medium in a direction intersecting a transport direction of the medium and also toward the medium guide, during the transport of the medium, wherein the biasing mechanism includes a plurality of nip rollers arranged in a direction intersecting the transport direction, and when a nip pressure by a first nip roller of the plurality of nip rollers is compared with a nip pressure by a second nip roller of the plurality of nip rollers, with the second nip roller being distanced farther from the medium guide than the first nip roller, the nip pressure by the first nip roller is higher than the nip pressure by the second nip roller.

2. The printing apparatus according to claim 1, wherein when a nip pressure in a first roller region by one of the plurality of the nip rollers is compared with a nip pressure in a second roller region by the one of the plurality of the nip rollers, with the first roller region being a region that is located close to the medium guide and the second roller region being a region that is distanced farther from the medium guide than the first roller region, the nip pressure in the first roller region is higher than the nip pressure in the second roller region.

3. The printing apparatus according to claim 1, wherein the medium guide is provided at a side of the one edge of the medium, and the other edge of the medium is free without being constrained.

* * * * *